US009316996B2

(12) United States Patent
Mizutani

(10) Patent No.: US 9,316,996 B2
(45) Date of Patent: Apr. 19, 2016

(54) IMAGE FORMING APPARATUS, TONER STORING CONTAINER

(71) Applicant: KYOCERA Document Solutions Inc., Osaka-shi, Osaka (JP)

(72) Inventor: Naoki Mizutani, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/663,372

(22) Filed: Mar. 19, 2015

(65) Prior Publication Data

US 2015/0277286 A1 Oct. 1, 2015

(30) Foreign Application Priority Data

Mar. 26, 2014 (JP) ..... 2014-063656

(51) Int. Cl.
*G03G 21/10* (2006.01)
*G03G 21/12* (2006.01)

(52) U.S. Cl.
CPC ..... *G03G 21/10* (2013.01); *G03G 21/12* (2013.01); *G03G 21/105* (2013.01)

(58) Field of Classification Search
CPC . G03G 15/0886; G03G 21/10; G03G 21/105; G03G 21/12; G03G 2215/067; G03G 2215/0692
See application file for complete search history.

(56) References Cited

U.S. PATENT DOCUMENTS

2004/0047651 A1* 3/2004 Koyama ..... G03G 15/0868 399/120
2006/0257172 A1* 11/2006 Seo ..... G03G 21/105 399/258
2007/0248384 A1* 10/2007 Kawai ..... G03G 15/0877 399/260
2010/0080600 A1* 4/2010 Okamoto ..... G03G 21/12 399/71
2014/0270821 A1* 9/2014 Takahashi ..... G03G 21/105 399/35

FOREIGN PATENT DOCUMENTS

JP 2002311772 A 10/2002

* cited by examiner

*Primary Examiner* — Rodney Bonnette
(74) *Attorney, Agent, or Firm* — Alleman Hall McCoy Russell & Tuttle LLP

(57) ABSTRACT

Image forming apparatus includes conveyance portion, discharge portion, opening/closing portion, and toner storing portion. Conveyance portion conveys toner along axis direction of image carrier. In discharge portion, discharge outlet is formed such that toner conveyed by conveyance portion is dropped from discharge outlet. Opening/closing portion is provided on discharge portion and moves in axis direction in such way as to open and close discharge outlet. Toner storing portion includes opening portion, restriction portion, and cover portion. Opening portion has insertion opening into which discharge portion is inserted in conveyance direction in which toner is conveyed. Restriction portion contacts part of opening/closing portion and restricts movement of opening/closing portion when discharge portion is inserted into insertion opening. Cover portion is provided at predetermined position that corresponds to area under insertion area of opening/closing portion that is inserted in conveyance direction exceeding position at which opening/closing portion contacts restriction portion.

7 Claims, 7 Drawing Sheets

IMAGE FORMING APPARATUS, TONER STORING CONTAINER

INCORPORATION BY REFERENCE

This application is based upon and claims the benefit of priority from the corresponding Japanese Patent Application No. 2014-063656 filed on Mar. 26, 2014, the entire contents of which are incorporated herein by reference.

BACKGROUND

The present disclosure relates to an image forming apparatus configured to form an image by the electrophotography, and to a toner storing container to be attached to the image forming apparatus.

In an image forming apparatus such as a printer that can form an image by the electrophotography, there is known a configuration in which toner removed from a surface of an image carrier such as a photoconductor drum and conveyed to a toner discharge outlet is recovered in a toner storing container attached to the toner discharge outlet. In this type of image forming apparatus, the toner storing container is attached to or detached from the toner discharge outlet for the purpose of, for example, discarding the toner in the toner storing container. Here, the toner might drop and smear the inside of the apparatus when the toner storing container is attached to or detached from the toner discharge outlet in the state where the toner discharge outlet is opened to the inside of the apparatus. In connection with this, there is known a configuration in which an opening/closing portion opens and closes the toner discharge outlet inside the toner storing container in conjunction with operations of a worker attaching and detaching the toner storing container.

SUMMARY

An image forming apparatus according to an aspect of the present disclosure includes a conveyance portion, a discharge portion, an opening/closing portion, and a toner storing portion. The conveyance portion is configured to convey toner along an axis direction of an image carrier. In the discharge portion, a discharge outlet is formed such that the toner conveyed by the conveyance portion is dropped from the discharge outlet. The opening/closing portion is provided on the discharge portion and configured to move in the axis direction in such a way as to open and close the discharge outlet. The toner storing portion includes an opening portion, a restriction portion, and a cover portion. The opening portion has an insertion opening into which the discharge portion is inserted in a conveyance direction in which the toner is conveyed by the conveyance portion. The restriction portion is configured to contact a part of the opening/closing portion and restrict movement of the opening/closing portion when the discharge portion is inserted into the insertion opening. The cover portion is provided at a predetermined position that corresponds to an area under an insertion area of the opening/closing portion that is inserted in the conveyance direction exceeding a position at which the opening/closing portion contacts the restriction portion.

A toner storing container according to another aspect of the present disclosure is to be attached to an image forming apparatus that includes a conveyance portion configured to convey toner along an axis direction of an image carrier, a discharge portion in which a discharge outlet is formed such that the toner conveyed by the conveyance portion is dropped from the discharge outlet, and an opening/closing portion provided on the discharge portion and configured to move in the axis direction in such a way as to open and close the discharge outlet, and includes an opening portion, a restriction portion, and a cover portion. The opening portion has an insertion opening into which the discharge portion is inserted in a conveyance direction in which the toner is conveyed by the conveyance portion. The restriction portion is configured to contact a part of the opening/closing portion and restrict movement of the opening/closing portion when the discharge portion is inserted into the insertion opening. The cover portion is provided at a predetermined position that corresponds to an area under an insertion area of the opening/closing portion that is inserted in the conveyance direction exceeding a position at which the opening/closing portion contacts the restriction portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the disclosure. It should be noted that the following description is an example of a specific embodiment of the present disclosure and should not limit the technical scope of the present disclosure.

[Outlined Configuration of Image Forming Apparatus 10]

Figure 1:
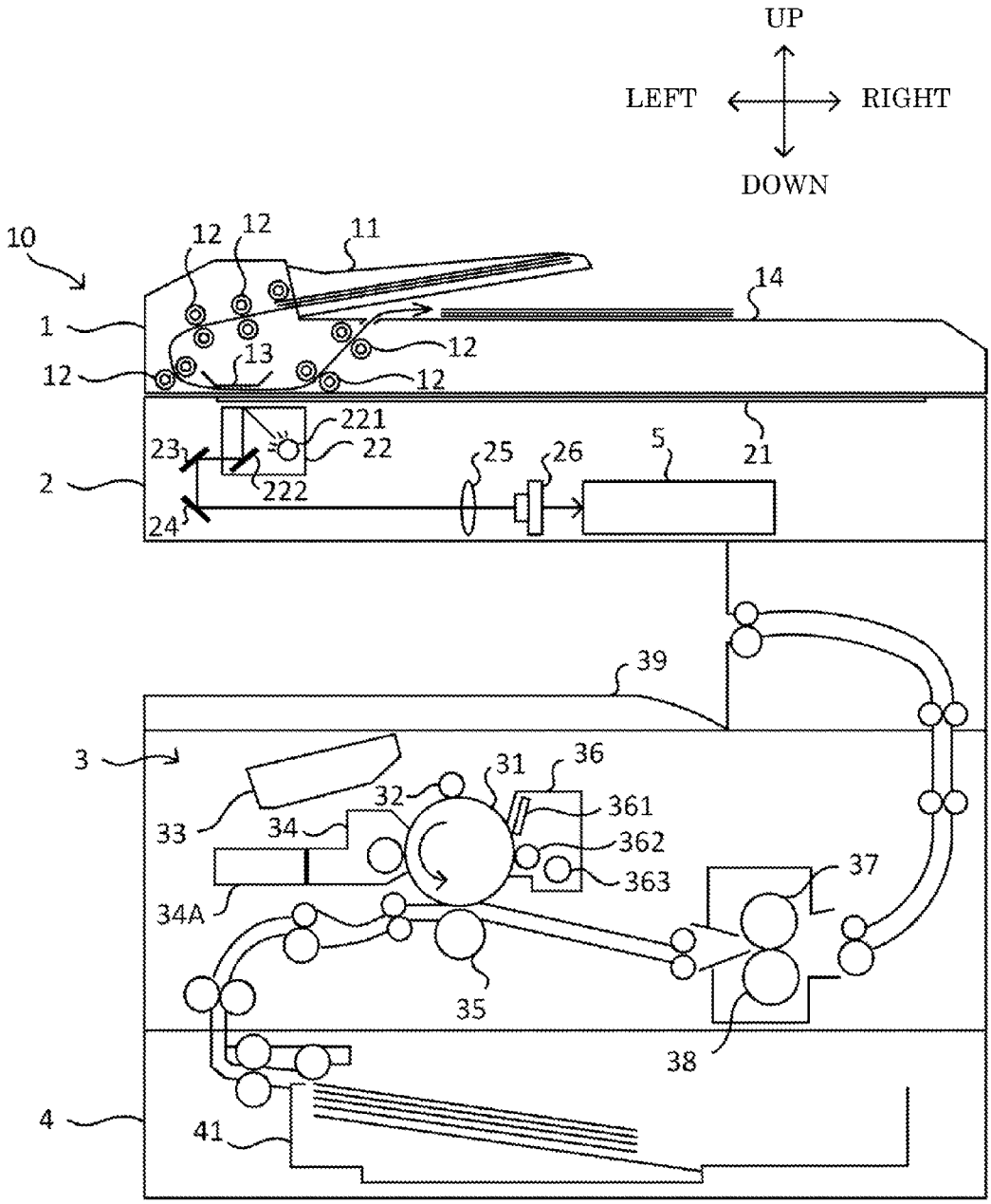
FIG. 1 is a diagram showing the configuration of an image forming apparatus according to an embodiment of the present disclosure.
Figure 2:
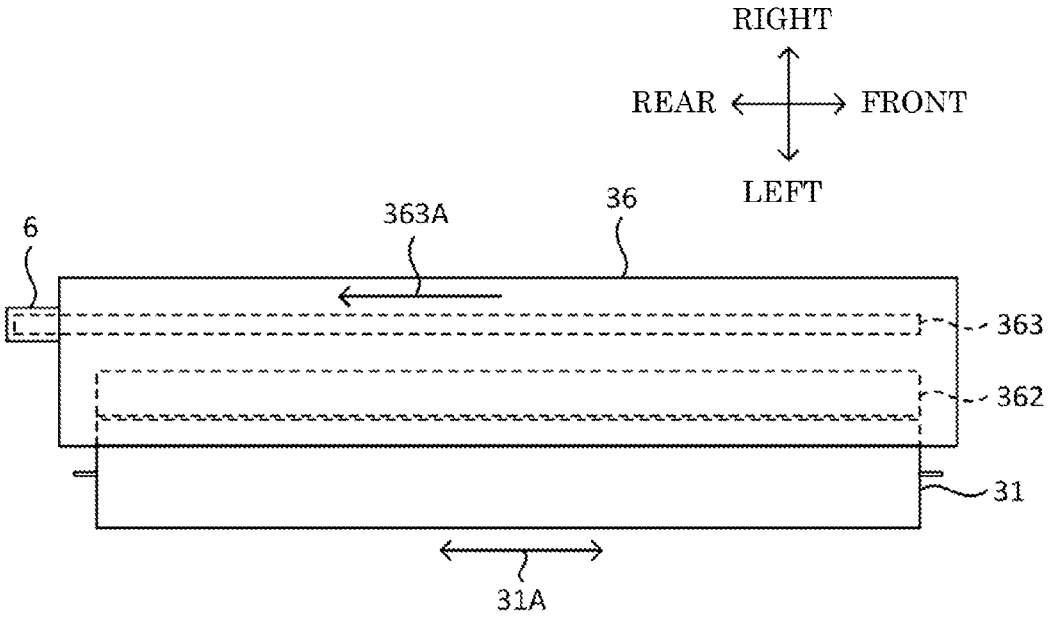
FIG. 2 is a diagram showing the configuration of a cleaning device of the image forming apparatus in an embodiment of the present disclosure.

First, an outlined configuration of an image forming apparatus 10 in an embodiment of the present disclosure is described with reference to FIGS. 1 and 2. Here, FIG. 1 is a schematic cross-sectional view of the image forming apparatus 10. In addition, FIG. 2 is a schematic plan view showing the configuration of a cleaning device 36. It is noted that the front side on the plane of FIG. 1 is the front side of the image forming apparatus 10, and the depth side on the plane of FIG. 1 is the rear side of the image forming apparatus 10.

As shown in FIG. 1, the image forming apparatus 10 includes an ADF 1, an image reading portion 2, an image forming portion 3, a sheet feed portion 4, a control portion 5 and the like.

As shown in FIG. 1, the ADF 1 is an automatic document sheet feeding device and includes a document sheet setting portion 11, a plurality of conveying rollers 12, a document sheet pressing 13, and a sheet discharge portion 14. In the ADF 1, the plurality of conveying rollers 12 are driven by motors (not shown) such that the document sheet placed on the document sheet setting portion 11 is conveyed in such a way as to pass through an image data reading position where the image data is read by the image reading portion 2, and then conveyed to the sheet discharge portion 14. With this configuration, the image reading portion 2 can read image data from the document sheet conveyed by the ADF 1.

As shown in FIG. 1, the image reading portion 2 includes a document sheet table 21, a reading unit 22, a mirror 23, a mirror 24, an optical lens 25, and a CCD (Charge Coupled Device) 26. The reading unit 22 includes an LED light source 221 and a mirror 222.

Specifically, as shown in FIG. 1, the image forming portion 3 includes a photoconductor drum 31, a charging device 32, an optical scanning device (LSU) 33, a developing device 34, a transfer roller 35, a cleaning device 36, a fixing roller 37, a pressure roller 38, and a sheet discharge tray 39. It is noted that the toner (developer) is supplied to the developing device 34 from a toner container 34A that is attachable and detachable to/from the image forming portion 3.

On the other hand, toner that has remained on the surface of the photoconductor drum 31 is removed by the cleaning device 36. Specifically, as shown in FIGS. 1 and 2, the cleaning device 36 includes a cleaning member 361, a polishing roller 362, and a conveyance screw 363. The cleaning member 361 is a blade-like member configured to remove the remaining toner that has adhered to the surface of the photoconductor drum 31. The polishing roller 362 polishes the surface of the photoconductor drum 31 by causing the toner that has been removed by the cleaning member 361, to be adhered to its surface. The conveyance screw 363 conveys the toner removed by the cleaning member 361 to a discharge portion 6 that is described below, along an axis direction 31A of the photoconductor drum 31. Here, the photoconductor drum 31 is an example of the image carrier of the present disclosure. In addition, the conveyance screw 363 is an example of the conveyance portion of the present disclosure.

Meanwhile, in an image forming apparatus such as the image forming apparatus 10, there is known a configuration in which the toner removed from the surface of an image carrier such as the photoconductor drum and conveyed to a toner discharge outlet is recovered in a toner storing container attached to the toner discharge outlet. In this type of image forming apparatus, the toner storing container is attached to or detached from the toner discharge outlet, for the purpose of, for example, discarding the toner in the toner storing container. Here, the toner might drop and smear the inside of the apparatus when the toner storing container is attached to or detached from the toner discharge outlet in the state where the toner discharge outlet is opened to the inside of the apparatus. In connection with this, there is known a configuration in which an opening/closing portion opens and closes the toner discharge outlet inside the toner storing container in conjunction with operations of a worker attaching and detaching the toner storing container.

However, when, as in the above-described related technology, the toner discharge outlet is opened and closed inside the toner storing container in conjunction with operations of a worker attaching and detaching the toner storing container, the opening/closing portion is inserted into the toner storing container and the toner adheres to the opening/closing portion inside the toner storing container. As a result, when, for example, the toner storing container is removed from the toner discharge outlet, the toner that has adhered to the opening/closing portion may drop and smear the inside of the apparatus. On the other hand, as described below, the image forming apparatus 10 can restrict the adhering of the toner to the opening/closing portion that opens and closes the toner discharge outlet inside the toner storing container in conjunction with operations of attaching and detaching the toner storing container.

Figure 3:
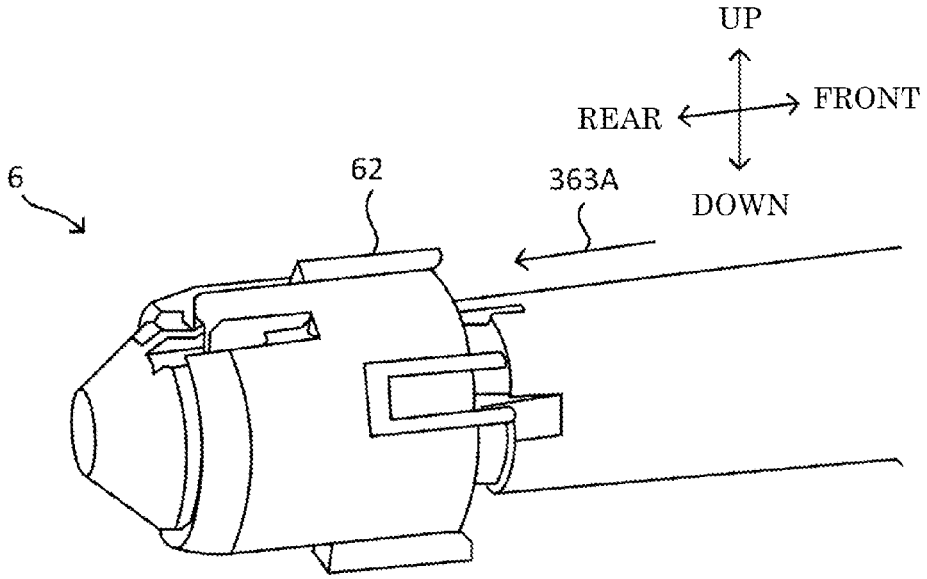
FIG. 3 is a diagram showing the configuration of a discharge portion of the image forming apparatus in an embodiment of the present disclosure.
Figure 4:
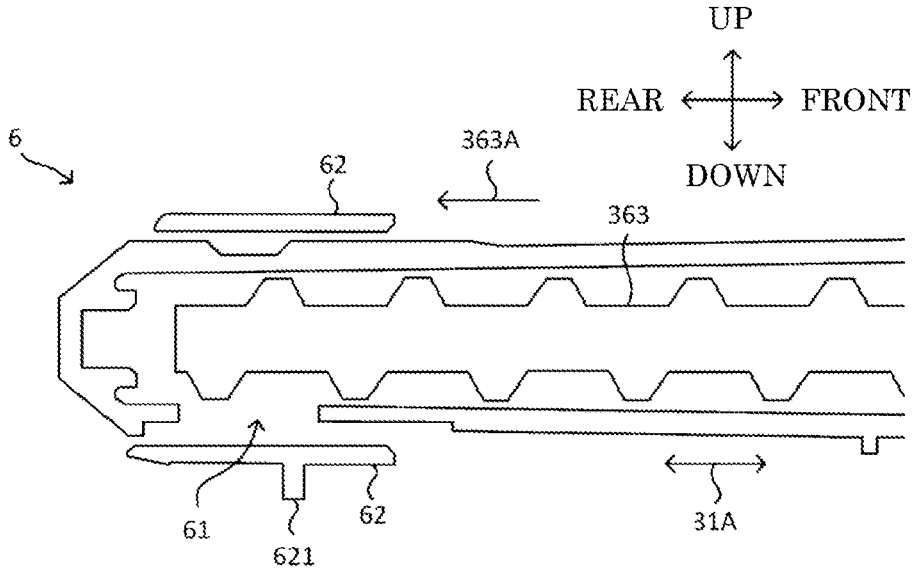
FIG. 4 is a diagram showing the configuration of the discharge portion of the image forming apparatus in an embodiment of the present disclosure.
Figure 5:
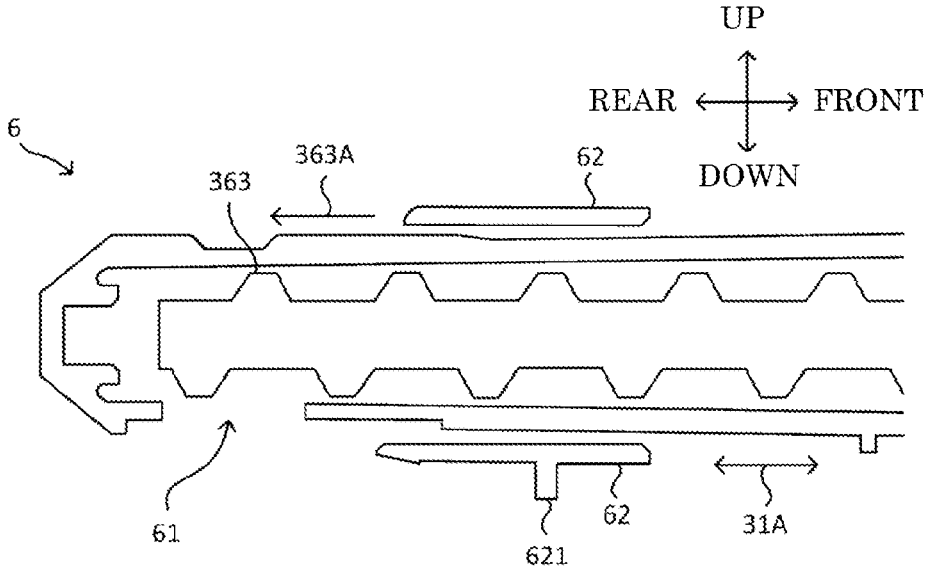
FIG. 5 is a diagram showing the configuration of the discharge portion of the image forming apparatus in an embodiment of the present disclosure.

First, the discharge portion 6 is described with reference to FIGS. 2 through 5. Here, FIG. 3 is a perspective view of the discharge portion 6. FIG. 4 is a cross-sectional view of the discharge portion 6 in the state where a discharge outlet 61 is closed. FIG. 5 is a cross-sectional view of the discharge portion 6 in the state where the discharge outlet 61 is opened.

As shown in FIG. 2, the discharge portion 6 is provided at a rear end of the housing of the cleaning device 36, projecting therefrom in the axis direction 31A in correspondence with the location of the conveyance screw 363 in the cleaning device 36. Here, the conveyance screw 363 conveys toner in a conveyance direction 363A that is the same direction as the discharge portion 6 projects, and the conveyance screw 363 extends in the conveyance direction 363A up to the discharge portion 6 and the front end thereof is inside the discharge portion 6. As a result, the toner removed from the surface of the photoconductor drum 31 is conveyed to the discharge portion 6 by the conveyance screw 363.

In addition, as shown in FIGS. 4 and 5, at the front end of the discharge portion 6 in the conveyance direction 363A, the discharge outlet 61 is provided such that the toner conveyed by the conveyance screw 363 is dropped from the discharge outlet 61. It is noted that the discharge outlet 61 is formed in a part of the circumferential surface of the discharge portion 6 that is parallel to the conveyance direction 363A. Furthermore, as shown in FIGS. 3 through 5, the discharge portion 6 is provided with an opening/closing portion 62 that is movable in the axis direction 31A in such a way as to open and close the discharge outlet 61.

Specifically, as shown in FIG. 3, the opening/closing portion 62 is formed in an annular shape covering the outer circumference of the discharge portion 6, and includes a protruding portion 621 protruding downward from the bottom thereof. It is noted that the opening/closing portion 62 may be formed in such a way as to cover a part of the outer circumferential surface of the discharge portion 6. In addition, a guide rail (not shown) is formed on the outer circumference of the discharge portion 6. The opening/closing portion 62 is supported by the guide rail so as to be slidable in the axis direction 31A. Furthermore, the opening/closing portion 62 is biased in the conveyance direction 363A by an elastic member (not shown) such as a coil spring in such a way as to move in the conveyance direction 363A and close the discharge outlet 61, as shown in FIG. 4. On the other hand, when the opening/closing portion 62 is moved in a direction opposite to the conveyance direction 363A by a force exceeding the biasing force of the elastic member, the discharge outlet 61 is opened, as shown in FIG. 5.

Figure 6:
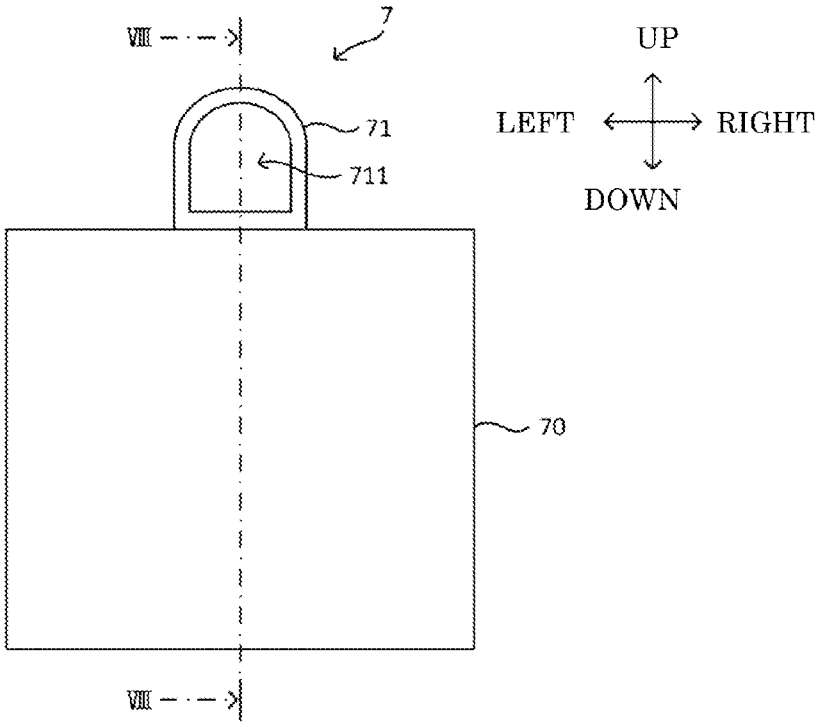
FIG. 6 is a diagram showing the configuration of a toner storing container to be attached to the image forming apparatus in an embodiment of the present disclosure.
Figure 7:
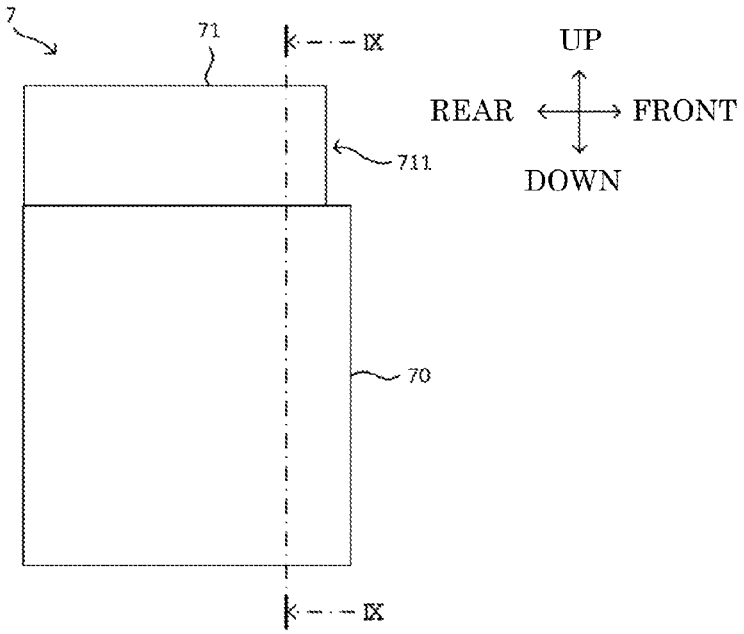
FIG. 7 is a diagram showing the configuration of the toner storing container to be attached to the image forming apparatus in an embodiment of the present disclosure.
Figure 8:
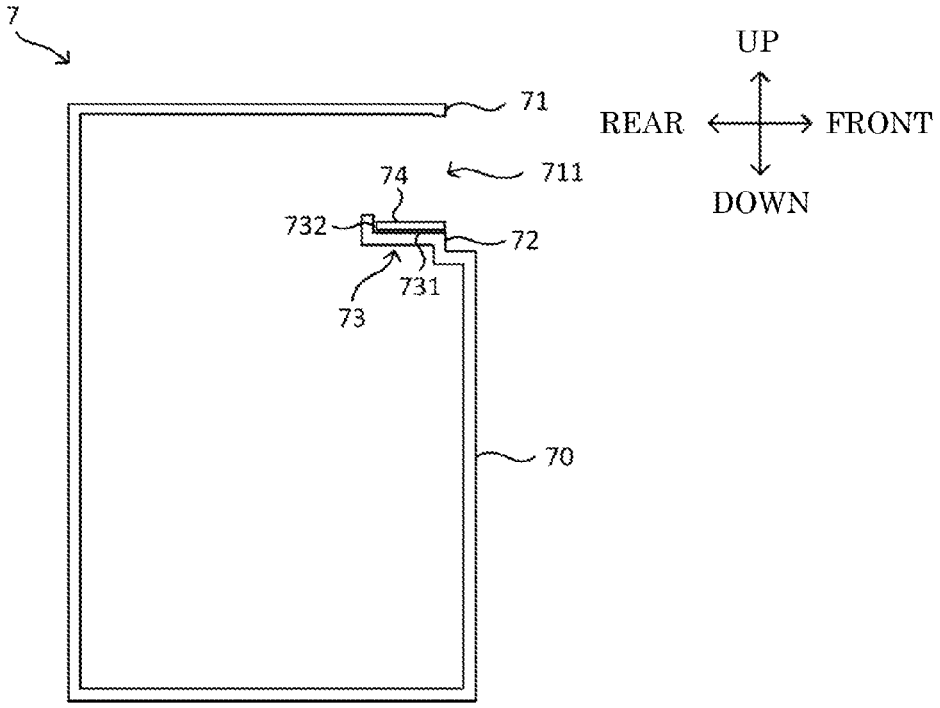
FIG. 8 is a diagram showing the configuration of the toner storing container to be attached to the image forming apparatus in an embodiment of the present disclosure.
Figure 9:
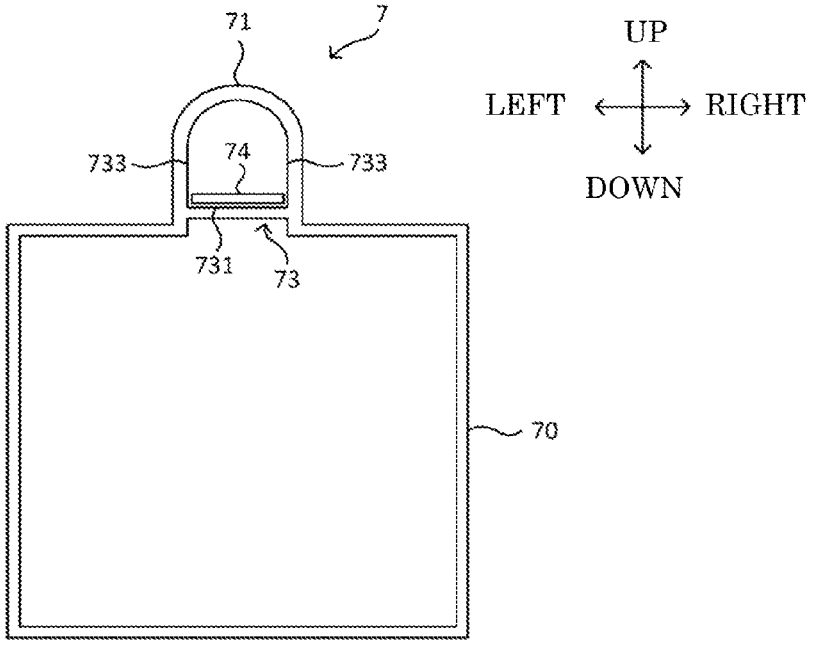
FIG. 9 is a diagram showing the configuration of the toner storing container to be attached to the image forming apparatus in an embodiment of the present disclosure.
Figure 10:
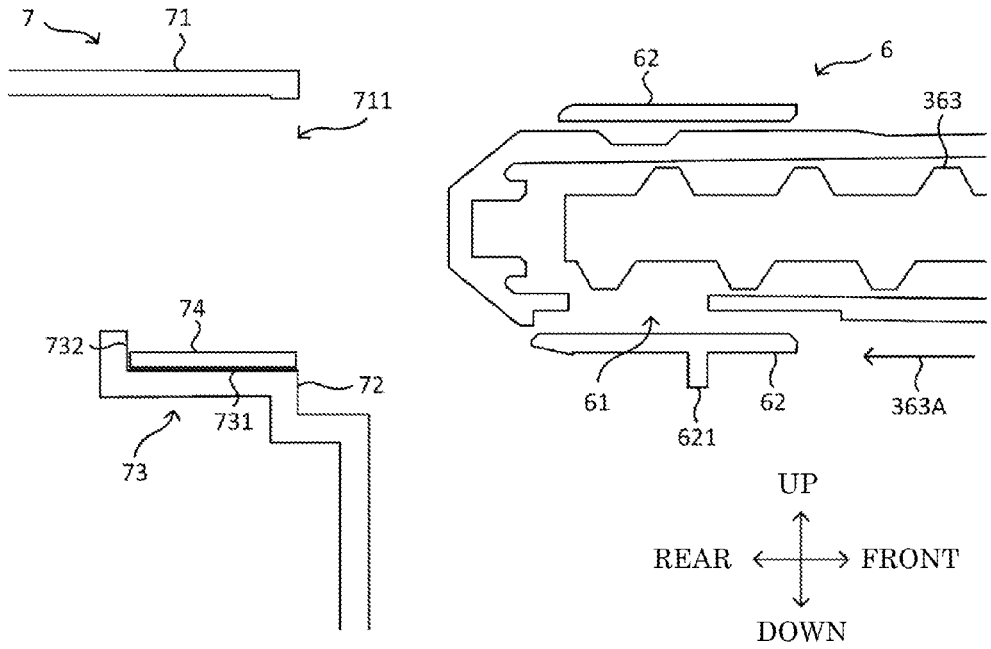
FIG. 10 is a diagram showing a flow of attaching the toner storing container to the image forming apparatus in an embodiment of the present disclosure.
Figure 11:
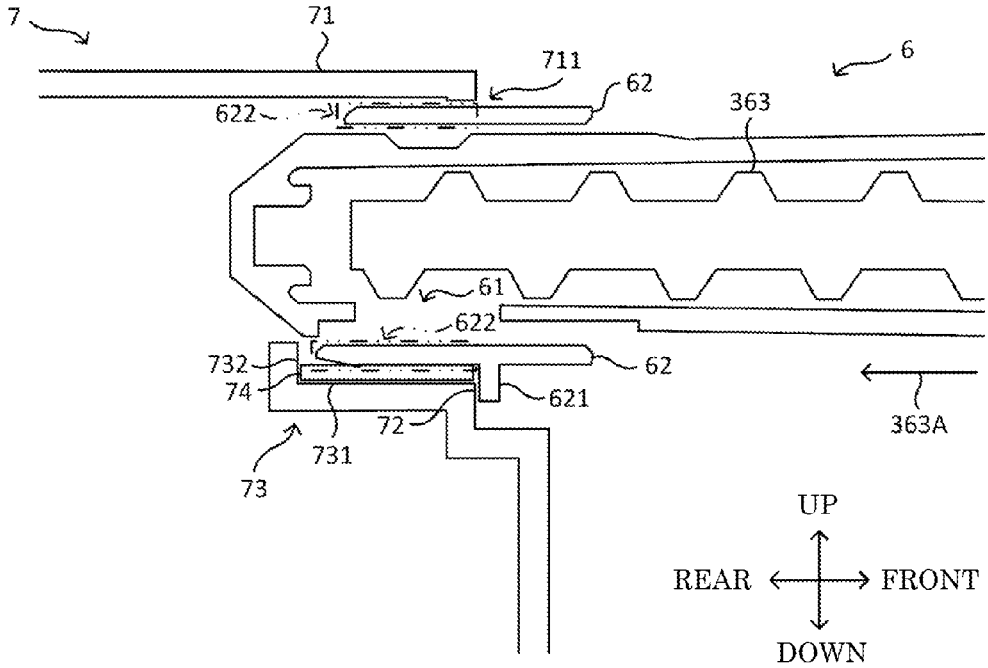
FIG. 11 is a diagram showing a flow of attaching the toner storing container to the image forming apparatus in an embodiment of the present disclosure.
Figure 12:
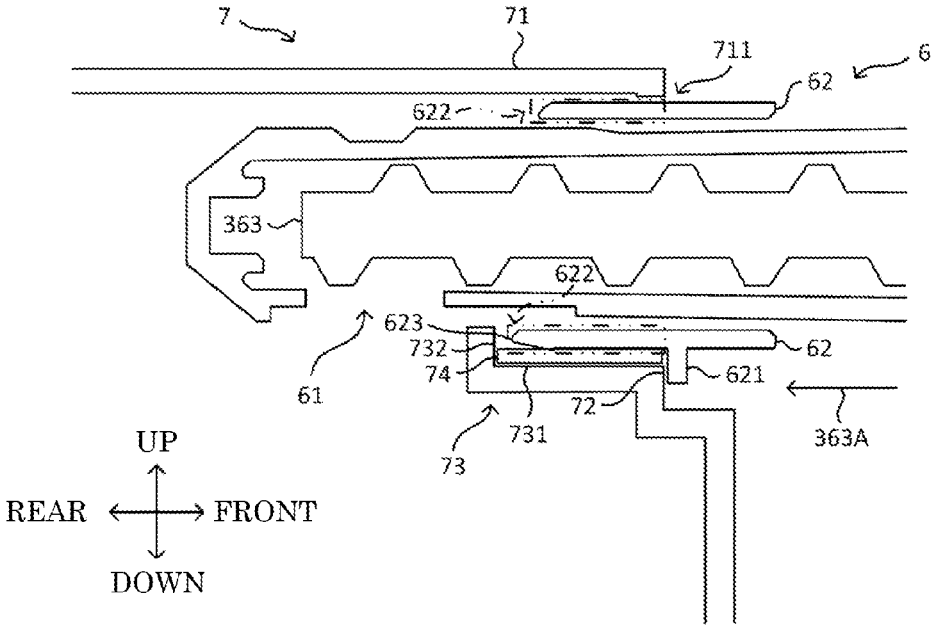
FIG. 12 is a diagram showing a flow of attaching the toner storing container to the image forming apparatus in an embodiment of the present disclosure.

Next, a toner storing container 7 is explained with reference to FIGS. 6 through 12. Here, FIG. 6 is a front view of the toner storing container 7, and FIG. 7 is a left side view of the toner storing container 7. FIG. 8 is a cross section taken along line VIII-VIII of FIG. 6 and viewed from a direction indicated by the arrows. FIG. 9 is a cross section taken along line IX-IX of FIG. 7 and viewed from a direction indicated by the arrows. It is noted that, with regard to FIGS. 6 through 9, the up-down direction, left-right direction, and front-rear direction are defined based on the state where the toner storing container 7 is attached to the discharge portion 6. Furthermore, FIG. 10 is a diagram showing the state before the discharge portion 6 is inserted into the toner storing container 7. FIG. 11 is a diagram showing the state where the discharge portion 6 is inserted into the toner storing container 7 and the protruding portion 621 is in contact with a restriction portion 72. FIG. 12 is a diagram showing the state where the restriction portion 72 is restricting the movement of the opening/closing portion 62 and the discharge outlet 61 is opened. It is noted that in FIGS. 11 and 12, an area enclosed by a two-dot chain line indicates an insertion area 622.

The toner storing container 7 is a container that is attached to the discharge portion 6 and stores the toner discharged from the discharge outlet 61. Specifically, as shown in FIGS. 6 and 7, the toner storing container 7 includes a container main body 70 and an opening portion 71, wherein the container main body 70 is substantially rectangular parallelpiped and has an inner space for storing the toner, and the opening portion 71 is formed on the upper surface of the container main body 70 such that the discharge portion 6 can be inserted therein. The toner storing container 7 is, for example, integrally formed from resin. Here, the toner storing container 7 is an example of the toner storing portion of the present disclosure.

As shown in FIGS. 6, 7 and 10, the opening portion 71 is provided on the upper surface of the toner storing container 7, and has an insertion opening 711 into which the discharge portion 6 is inserted in the conveyance direction 363A (the rear direction in FIG. 7). Specifically, as shown in FIG. 6, the opening portion 71 is formed in the shape of an arch in such a way as to protrude upward from the upper surface of the toner storing container 7. In addition, as shown in FIGS. 7 and 10, the opening portion 71 is formed in an elongated shape extending in the conveyance direction 363A from the position at which the insertion opening 711 is formed. With the configuration where the opening portion 71 is provided on the upper surface of the toner storing container 7, when the discharge portion 6 is inserted into the opening portion 71 from the insertion opening 711, the sides and top of the discharge portion 6 are surrounded by the inner circumferential surface of the opening portion 71. This restricts the toner that scatters in the container, from adhering to the sides and top of the discharge portion 6.

As shown in FIGS. 8 and 9, the toner storing container 7 includes the restriction portion 72, a cover portion 73, and a cleaning portion 74.

When the discharge portion 6 is inserted into the insertion opening 711, the restriction portion 72 contacts the protruding portion 621 of the opening/closing portion 62 and restricts the movement of the opening/closing portion 62. Specifically, as shown in FIG. 8, the restriction portion 72 is an edge of the insertion opening 711, wherein the position of the restriction portion 72 corresponds to the position of the protruding portion 621 on the opening/closing portion 62. That is, in the toner storing container 7, the insertion opening 711 is formed in such a size that allows the protruding portion 621 to contact the edge of the insertion opening 711 when the discharge portion 6 is inserted into the insertion opening 711. Furthermore, as shown in FIGS. 11 and 12, when the discharge portion 6 is further inserted in the conveyance direction 363A from the state where the protruding portion 621 of the opening/closing portion 62 is in contact with the restriction portion 72, the opening/closing portion 62 moves in the opposite direction to the conveyance direction 363A, moving relative to the discharge portion 6, and the discharge outlet 61 is opened.

Here, in the image forming apparatus 10, the protruding portion 621 is provided on the rear side of the discharge portion 6 in the conveyance direction 363A. As a result, when the discharge portion 6 is inserted into the insertion opening 711, the restriction portion 72 contacts the protruding portion 621 after the discharge outlet 61 enters and is inside the toner storing container 7. This prevents the discharge outlet 61 from being opened near the insertion opening 711. On the other hand, as shown in FIGS. 11 and 12, the opening/closing portion 62 has the insertion area 622 that is inserted in the conveyance direction 363A exceeding the position at which the opening/closing portion 62 contacts the restriction portion 72. As a result, there is a possibility that toner discharged from the discharge outlet 61 or toner scattering inside the toner storing container 7 may adhere to the insertion area 622. To prevent the toner from adhering to the insertion area 622, the cover portion 73 is provided in the toner storing container 7.

The cover portion 73 is provided in the toner storing container 7 at a predetermined position that corresponds to an area under the insertion area 622. Specifically, as shown in FIG. 8, the cover portion 73 is formed in such a way as to protrude from the lower edge of the insertion opening 711 in the conveyance direction 363A (the rear direction in FIG. 8). This makes it possible to position the cover portion 73 directly below the insertion area 622, and effectively restrict the toner from adhering to the insertion area 622 inside the container. It is noted that the position of the cover portion 73 is not limited to the above-described position, but may be disposed at any other position as far as it is possible to restrict the toner from adhering to the insertion area 622.

In addition, as shown in FIGS. 8 and 12, the cover portion 73 includes a first surface 731 and a second surface 732, wherein the first surface 731 is provided at a position that corresponds to an area under the insertion area 622, and the second surface 732 is erected upward from the first surface 731 at a position between a tip 623 of the opening/closing portion 62 and the discharge outlet 61 in the state where the discharge portion 6 has been inserted in the insertion opening 711. With this configuration, the tip 623 of the opening/closing portion 62 is covered with the second surface 732, and thereby the effect of restricting the adhering of the toner is improved.

Furthermore, as shown in FIG. 9, the cover portion 73 includes third surfaces 733 which are erected upward from the first surface 731 at positions corresponding to the side surfaces of the opening/closing portion 62 in the state where the discharge portion 6 has been inserted in the insertion opening 711. With this configuration, the side surfaces of the opening/closing portion 62 are covered with the third surfaces 733, and thereby the effect of restricting the adhering of the toner is further improved. It is noted that, in another embodiment, the third surfaces 733 may be omitted.

Meanwhile, in the toner storing container 7, the cover portion 73 is integrally formed with the opening portion 71 in such a way as to face the inner circumferential surface of the opening portion 71. Specifically, as shown in FIG. 9, the cover portion 73 is formed in the shape of a flat plate and disposed perpendicular to the third surfaces 733. This configuration restricts, during molding of the toner storing container 7, generation of a sink mark, toppling, or shrinkage on the wall parts constituting the third surfaces 733 of the opening portion 71, thereby improving the molding accuracy of the toner storing container 7. It is noted that forming the cover portion 73 in the shape of a flat plate disposed perpendicular to the third surfaces 733 provides a higher effect of improving the molding accuracy than forming it in other shapes such as a curved shape.

As shown in FIG. 8, the cleaning portion 74 is provided on the cover portion 73, and when the discharge portion 6 is inserted into and removed from the insertion opening 711, the cleaning portion 74 makes sliding contact with the opening/closing portion 62 with friction and cleans the opening/closing portion 62. The cleaning portion 74 is, for example, an elastic member such as sponge provided on the first surface 731 of the cover portion 73. It is noted that, in another embodiment, the cleaning portion 74 may be omitted.

Next, a procedure for attaching the toner storing container 7 to the discharge portion 6 is described with reference to FIGS. 10 through 12.

First, a worker who is going to attach the toner storing container 7 opens an exterior cover (not shown) that is provided in rear of the casing of the image forming apparatus 10, and exposes the discharge portion 6 to outside.

Next, the worker holds the toner storing container 7 with hands or the like such that the insertion opening 711 of the toner storing container 7 faces the discharge portion 6, as shown in FIG. 10. The worker then moves the toner storing container 7 in an opposite direction to the conveyance direction 363A, and inserts the discharge portion 6 into the insertion opening 711 until the protruding portion 621 contacts the restriction portion 72.

Here, as shown in FIGS. 10 and 11, when the discharge portion 6 is inserted into the insertion opening 711 by the worker until the protruding portion 621 contacts the restriction portion 72, the insertion area 622 of the opening/closing portion 62 makes sliding contact with the cleaning portion 74 with friction while being moved. As a result, dirt of the insertion area 622 is cleaned by the cleaning portion 74.

Next, after the protruding portion 621 contacts the restriction portion 72, the worker further moves the toner storing container 7 in an opposite direction to the conveyance direction 363A and the discharge portion 6 is further inserted into the insertion opening 711. The movement of the opening/closing portion 62 is then restricted by the restriction portion 72, as shown in FIGS. 11 and 12, and the opening/closing portion 62 moves relative to the discharge portion 6, and the discharge outlet 61 is opened.

The worker then closes the exterior cover and ends the attachment of the toner storing container. It is noted that a stopper or the like may be used to restrict the toner storing container 7 that has been attached to the discharge portion 6, from moving in the front-rear direction.

Here, as shown in FIG. 12, the insertion area 622 of the opening/closing portion 62 that has been inserted in the toner storing container 7, is covered with the first surface 731 and the second surface 732 of the cover portion 73. This restricts the toner in the toner storing container 7 from adhering to the insertion area 622 while the toner storing container 7 is attached to the discharge portion 6. In addition, the third surfaces 733 of the cover portion 73 also restrict the toner from adhering to side surfaces of the insertion area 622.

It is noted that, when the toner storing container 7 is removed from the discharge portion 6, the insertion area 622 also makes sliding contact with the cleaning portion 74 with friction while being moved. As a result, even if the toner adheres to the insertion area 622 in the state where the toner storing container 7 is attached to the discharge portion 6, the toner is cleaned from the insertion area 622 by the cleaning portion 74.

As described above, in the image forming apparatus 10, the cover portion 73 of the toner storing container 7 restricts the toner from adhering to the opening/closing portion 62. As a result, it is possible to restrict toner leakage, for example, during attachment or detachment of the toner storing container 7.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a conveyance portion configured to convey toner removed from an image carrier along an axis direction of the image carrier;

a discharge portion in which a discharge outlet is formed such that the toner conveyed by the conveyance portion is dropped from the discharge outlet;

an opening/closing portion provided on the discharge portion and configured to move in the axis direction in such a way as to open and close the discharge outlet; and a toner storing portion, configured to store the toner from the discharge outlet, including:

an opening portion having an insertion opening into which the discharge portion is inserted in a conveyance direction in which the toner is conveyed by the conveyance portion;

a restriction portion configured to contact a part of the opening/closing portion and restrict movement of the opening/closing portion when the discharge portion is inserted into the insertion opening; and a cover portion provided at a predetermined position that corresponds to an area under an insertion area of the opening/closing portion that is inserted in the conveyance direction exceeding a position at which the opening/closing portion contacts the restriction portion.

2. The image forming apparatus according to claim 1, wherein the restriction portion is an edge of the insertion opening, and the cover portion is formed in such a way as to protrude from the edge in the conveyance direction.

3. The image forming apparatus according to claim 1, wherein the cover portion includes a first surface and a second surface, the first surface being provided at the predetermined position, and the second surface being erected upward from the first surface at a position between a tip of the opening/closing portion and the discharge outlet in a state where the discharge portion has been inserted in the insertion opening.

4. The image forming apparatus according to claim 3, wherein the cover portion further includes third surfaces which are erected upward from the first surface at positions corresponding to side surfaces of the opening/closing portion in a state where the discharge portion has been inserted in the insertion opening.

5. The image forming apparatus according to claim 1, wherein the toner storing portion includes a cleaning portion which is provided in the cover portion and configured to make sliding contact with the opening/closing portion with friction when the discharge portion is inserted into and removed from the insertion opening.

6. The image forming apparatus according to claim 1, wherein the opening portion is formed in such a way as to protrude upward from an upper surface of the toner storing portion, and formed in an elongated shape extending in the conveyance direction, and the cover portion is integrally formed with the opening portion in such a way as to face an inner circumferential surface of the opening portion.

7. A toner storing container, comprising:

a container configured to be attached to an image forming apparatus that includes a conveyance portion configured to convey toner removed from an image carrier along an axis direction of the image carrier, a discharge portion in which a discharge outlet is formed such that the toner conveyed by the conveyance portion is dropped from the discharge outlet, and an opening/closing portion provided on the discharge portion and configured to move in the axis direction in such a way as to open and close the discharge outlet, the toner storing container, configured to store the toner from the discharge outlet, further comprising:

an opening portion having an insertion opening into which the discharge portion is inserted in a conveyance direction in which the toner is conveyed by the conveyance portion;

a restriction portion configured to contact a part of the opening/closing portion and restrict movement of the opening/closing portion when the discharge portion is inserted into the insertion opening; and a cover portion provided at a predetermined position that corresponds to an area under an insertion area of the opening/closing portion that is inserted in the conveyance direction exceeding a position at which the opening/closing portion contacts the restriction portion.

* * * * *